US008690481B2

(12) United States Patent
Begley

(10) Patent No.: US 8,690,481 B2
(45) Date of Patent: Apr. 8, 2014

(54) REMOVABLE IMPACT COVER FOR A MARINE RISER BUOYANCY MODULE

(75) Inventor: Aaron Begley, Malaga (AU)

(73) Assignee: Matrix Composites and Engineering Limited, Malaga, Western Austrialia (AU)

( * ) Notice: Subject to any disclaimer, the term of this patent is extended or adjusted under 35 U.S.C. 154(b) by 388 days.

(21) Appl. No.: 12/773,037

(22) Filed: May 4, 2010

(65) Prior Publication Data

US 2010/0284750 A1 Nov. 11, 2010

(30) Foreign Application Priority Data

May 5, 2009 (AU) ..... 2009901968

(51) Int. Cl.
*E21B 17/01* (2006.01)
*B63B 22/00* (2006.01)

(52) U.S. Cl.
USPC ..... 405/211; 405/195.1; 405/224.2; 441/133

(58) Field of Classification Search
USPC ..... 405/195.1, 211, 212, 224.2; 441/133; 166/350
See application file for complete search history.

(56) References Cited

U.S. PATENT DOCUMENTS

| | | | | |
|---|---|---|---|---|
| 3,729,756 | A * | 5/1973 | Cook et al. | 441/133 |
| 4,474,129 | A * | 10/1984 | Watkins et al. | 114/243 |
| 6,067,922 | A * | 5/2000 | Denison et al. | 114/243 |
| 6,402,431 | B1 * | 6/2002 | Nish | 405/224.3 |
| 7,628,665 | B1 * | 12/2009 | Cook et al. | 441/133 |
| 2002/0146287 | A1 * | 10/2002 | Allen et al. | 405/211 |
| 2005/0241832 | A1 * | 11/2005 | Jones et al. | 166/367 |

* cited by examiner

*Primary Examiner* — Benjamin Fiorello
(74) *Attorney, Agent, or Firm* — Ohlandt, Greeley, Ruggiero & Perle, L.L.P.

(57) ABSTRACT

A removal impact cover (14) for a marine riser buoyancy module (10) has an arcuate shape with an open face (21). The cover (14) has a number of recesses (18) arranged to engage with recesses (22) on the module (10). The recesses (18) each contain an aperture (20) and the recesses (22) each contain an aperture (23). The cover (14) and the module (10) are engaged by fastening means preferably extending the apertures 20 and 23. More preferably the engaged cover (14) is spaced from the module (10) to reduce direct transmission of forces to the module (10).

3 Claims, 4 Drawing Sheets

REMOVABLE IMPACT COVER FOR A MARINE RISER BUOYANCY MODULE

FIELD OF THE INVENTION

The present invention relates to a removable impact cover for a marine riser buoyancy module.

Marine riser buoyancy modules are used when drilling offshore to confer a degree of buoyancy on the drilling riser assembly.

Typically, marine riser buoyancy modules have a tendency to become damaged in use. In this case the modules may have to be repaired or discarded and replaced which can be very costly. The previously known marine riser buoyancy modules have an impact resistant moulded skin but the skin is not removable.

The present invention provides an impact cover for a marine riser buoyancy module which reduces the possibility of a module being damaged in use compared to prior art devices.

SUMMARY OF THE INVENTION

In accordance with one aspect of the present invention there is provided a removable impact cover for a marine riser buoyancy module which comprises an elongated body which is generally arcuate in cross section and which has means for attachment to a marine riser module.

In accordance with a further aspect of the present invention there is provided a marine riser buoyancy module which has attached thereto a removable impact cover in accordance with the present invention.

DESCRIPTION OF THE DRAWINGS

The present invention will now be described, by way of example, with reference to the accompanying drawings, in which.

DESCRIPTION OF THE INVENTION

Figure 1:
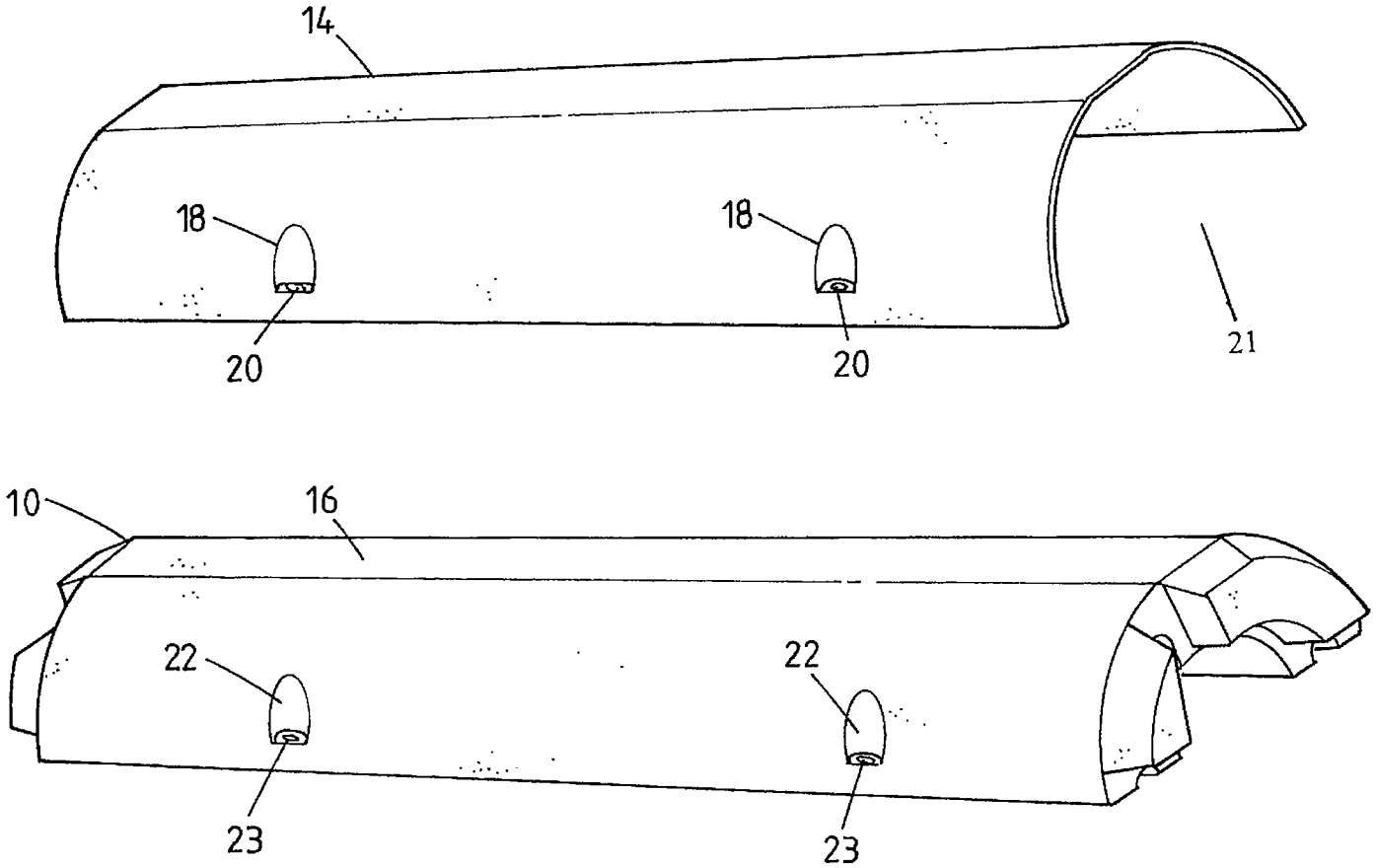
FIG. 1 is an exploded perspective view of a marine riser buoyancy module together with an impact cover in accordance with the present invention.
Figure 5:
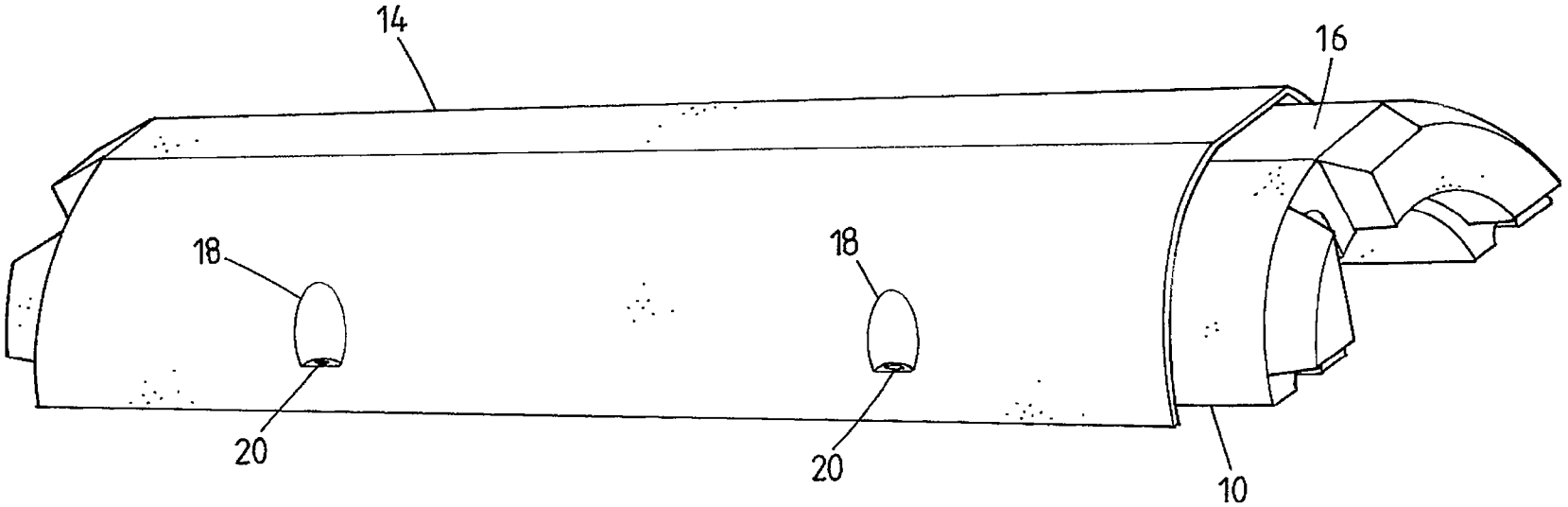
FIG. 5 is a perspective view of the apparatus of FIG. 1 with the module and the impact cover assembled together.
Figure 6:
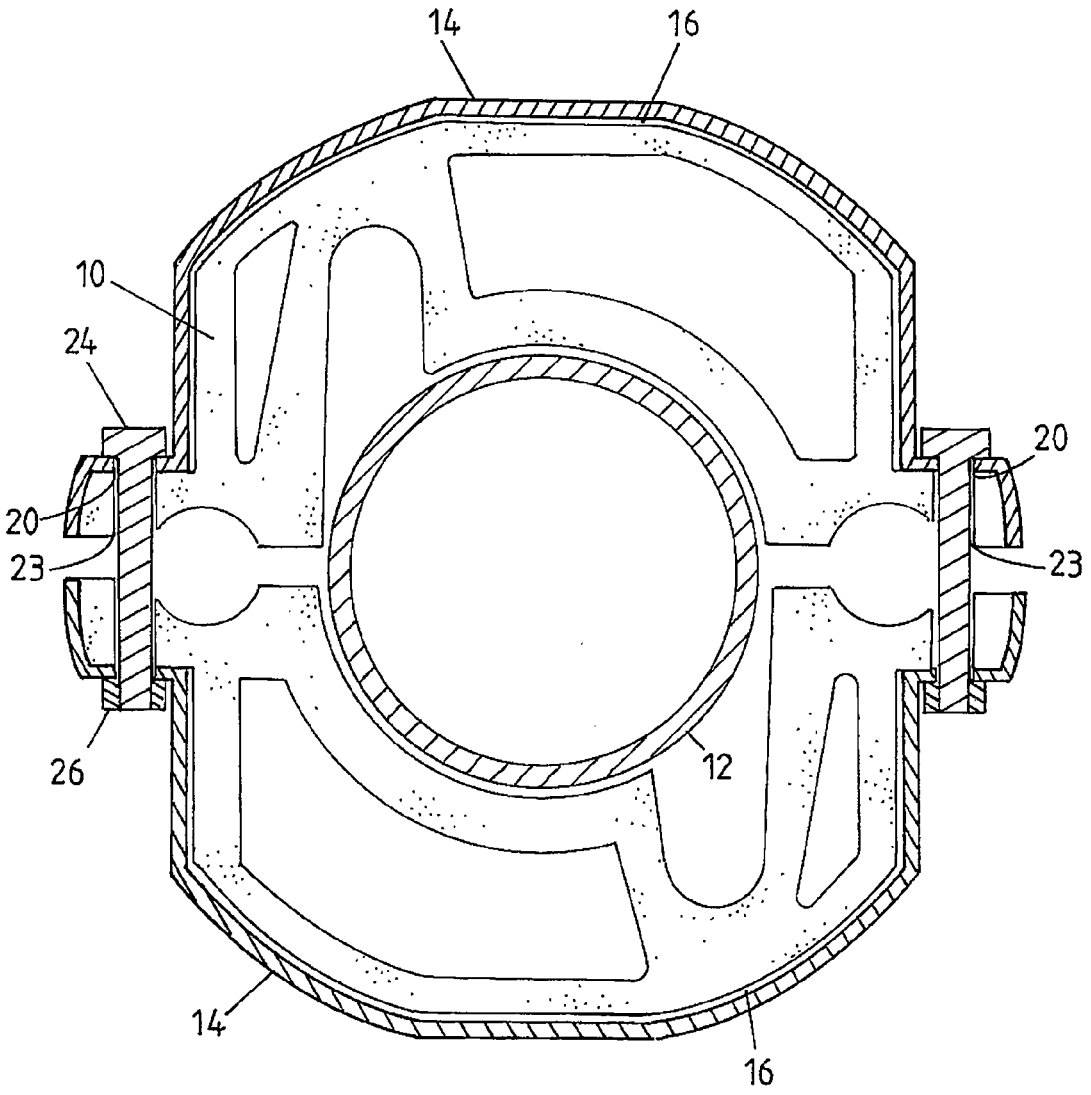
FIG. 6 is a cross sectional view of the apparatus of FIG. 5 along a line corresponding to the line 6-6 of FIG. 2.

Referring to FIGS. 1, 5 and 6 of the drawings, there is shown a marine riser buoyancy module 10 which is arranged to be mounted to a riser 12 of a drilling apparatus as shown in FIG. 6.

There is also shown an impact cover 14 which is arranged to be fitted to the module 10. In that respect the cover 14, especially as shown in FIGS. 2, 3 and 4, is elongated so as to be of similar length to the module 10 and is of substantially arcuate shape in cross section, as can best be seen in FIG. 4, so as to fit around an outer surface 16 of the module 10, as shown especially in FIG. 6.

Figure 4:
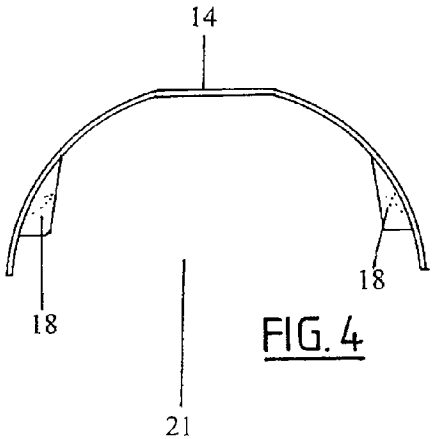
FIG. 4 is an end elevation of the impact cover of FIG. 2.
Figure 2:
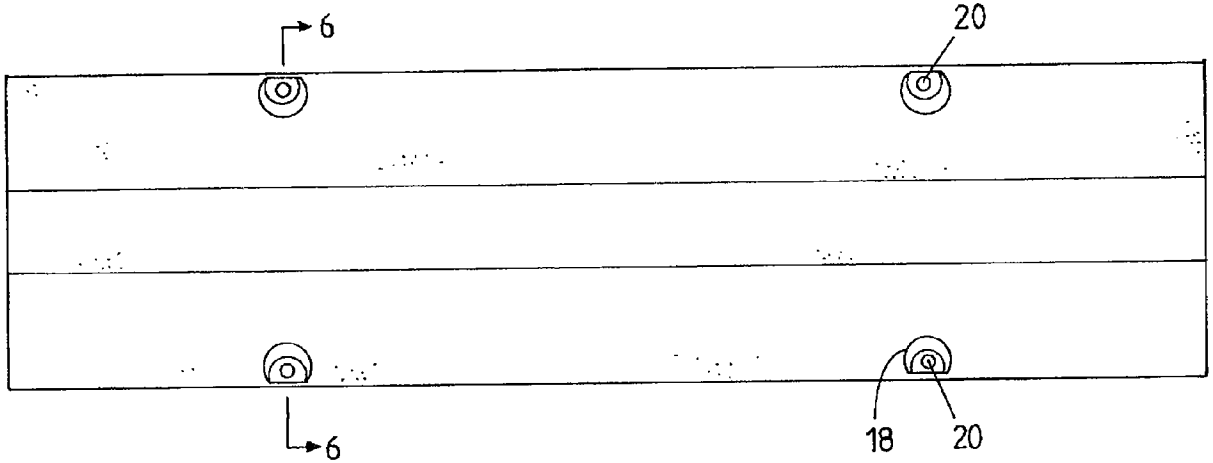
FIG. 2 is a plan view of the impact cover shown in FIG. 1.
Figure 3:
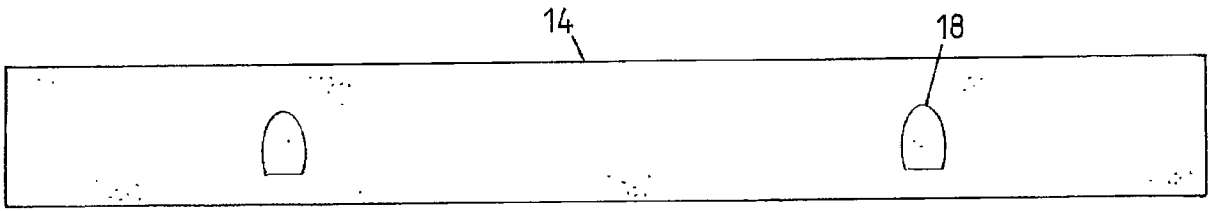
FIG. 3 is a side elevation of the impact cover of FIG. 2.

Further, as can be seen in the drawings, especially in FIGS. 2 to 4, the cover 14 is provided with a plurality of lateral recesses 18 each of which is provided with an aperture 20 facing an open end 21 of the cover 14. As can be seen in FIG. 4 material surrounding case recess 18 extends into an interior of the impact cover 14.

Similarly, the module 10 is provided with corresponding recesses 22 which are slightly larger than the recesses 18 so that the material surrounding the recesses 18 can be snugly received in the recesses 22. The recesses 22 are also provided with respective apertures 23.

The cover 14 is removably attached to the module 10 preferably during assembly stage of the module 10 onto the riser 12 in operation. This may be achieved by inserting fastening means such as threaded bolts 24 through the apertures 20 and 23 and securing the bolts in place by means of nuts 26 shown in FIG. 6.

However, the cover 14 may be secured to the module 10 by any convenient means such as by strapping as an alternative to the use of the threaded bolts 24 and nuts 26. Thus, the cover 14 is a separate item from the module 10. Further, the cover 14 preferably is, in fact, slightly spaced apart from the module 10 as can be seen in FIG. 6 so as to reduce direct transmission of sheer or impact forces to the module 10. Thus, the cover 14 performs a sacrificial function and can be removed and replaced if damaged which enables the module 10 to be available for reuse.

Conveniently, the cover 14 may be fastened to the module 10 using attachment hardware used to fasten two modules together onto the riser 12 as shown in FIG. 6.

Preferably, the cover 14 is made from a fibre reinforced thermoplastic composite material such as fibre reinforced polypropylene or thermoset fibre reinforced composite material such as glass or kevlar fibre reinforced epoxy material Modifications and variations as would be apparent to a skilled addressee are deemed to be within the scope of the present invention.

The invention claimed is:

1. A marine riser buoyancy module, comprising:

a pair of impact covers each having a first lateral recess and an arcuate cross section defining an open end, each first lateral recess having a first aperture and material extending into the open end;

a pair of modules each having an outer surface and a second lateral recess, each second lateral recess having a second aperture, each second lateral recess receiving the material of one of the first lateral recesses when the pair of impact covers are positioned about the pair of modules so that the open end is laterally spaced from the outer surface except where the second lateral recess receives the material of the first lateral recess; and attachment hardware extending through the first and second apertures to removably and separably secure the pair of impact covers to the pair of modules.

2. A marine riser buoyancy module having first and second removable impact covers attached thereto, said first and second removable impact covers each comprising an elongated body which is generally arcuate in cross section and which has attachment hardware for removable attachment to said marine riser module, wherein said first and second removable impact covers are each provided with a plurality of lateral recesses each of which is provided with a respective aperture;

said first and second removable impact covers being attached to the marine riser buoyancy module in opposition to said one another so that apertures of said first removal impact cover are aligned with corresponding apertures of said second removal impact cover;

said attachment hardware is received in said aligned apertures of said first and second removal impact covers so that said first removable impact cover and said second removable impact cover are detachably interconnected so as to surround symmetrically said marine riser buoyancy module laterally;

wherein said first and second removable impact covers are spaced from said marine riser buoyancy module so as to reduce direct transmission of shear or impact forces to said module, and said attachment hardware constitutes the sole means of interconnection between the detachably interconnected first and second removable impact covers.

3. A marine riser buoyancy module according to claim 2, wherein the said module is provided with a plurality of lateral recesses corresponding to respective recesses of said covers, each recess in said module being provided with an aperture, said recesses of said module being arranged to receive material surrounding said lateral recesses of said covers.

* * * * *